US006511711B2

(12) United States Patent
Quiel et al.

(10) Patent No.: US 6,511,711 B2
(45) Date of Patent: Jan. 28, 2003

(54) SLIDE BEAD COATING METHOD

(75) Inventors: Robert R. Quiel, Penfield, NY (US); Alain E. Gros, Rochester, NY (US); Douglas S. Finnicum, Penfield, NY (US); Felipe M. Joos, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/746,053

(22) Filed: Dec. 21, 2000

(65) Prior Publication Data

US 2002/0081390 A1 Jun. 27, 2002

(51) Int. Cl.[7] ..... B05D 1/26; B05D 3/14

(52) U.S. Cl. ..... 427/458; 427/470; 427/540; 427/402; 427/420

(58) Field of Search ..... 427/402, 420, 427/458, 470, 540; 118/410, 411, DIG. 4

(56) References Cited

U.S. PATENT DOCUMENTS

| | | | | | |
|---|---|---|---|---|---|
| 4,113,903 | A | * | 9/1978 | Choinski | 427/420 |
| 4,513,683 | A | * | 4/1985 | Kisler | 118/620 |
| 4,835,004 | A | * | 5/1989 | Kawanishi | 118/624 |
| 5,122,386 | A | | 6/1992 | Yoshida | |
| 5,295,039 | A | | 3/1994 | Nakajima et al. | |
| 6,127,003 | A | * | 10/2000 | Fukuda et al. | 427/535 |

FOREIGN PATENT DOCUMENTS

| | | |
|---|---|---|
| EP | 0 390 774 B1 | 7/1992 |
| EP | 0 530 752 B1 | 1/1999 |
| WO | WO 89/05477 | 6/1989 |

OTHER PUBLICATIONS

"Liquid Film Coatings, Scientific principles and their technological implications", Stephan F. Kistler, Peter M. Schweizer, Chapman & Hall, 1997, pp 447–450 (No month date).

Threshold of ribbing instability with Non–Newtonian fluids, F. Varela Lopez, L. Pauchard, M. Rosen and M. Rabaud, presented at the 3rd European Coating Symposium (1999) pp 177–182 (No month date).

"The influence of electrostatic assist on the coating window of slide and slot coating", F. Vandaele and G. Vancoppenolle, Agfa–Gavaert N.V., presented at the 3rd European Coating Symposium (1999), pp 247–252 (No month date).

Ribbing Instability in Coating Flows: Effect of Polymer Additives, T. Bauman, T. Sullivan, and S. Middleman, Oct. 5, 1981, Chem Eng. Commun., vol. 14, pp. 35–46.

* cited by examiner

*Primary Examiner*—Katherine A. Bareford
(74) *Attorney, Agent, or Firm*—Mark G. Bocchetti

(57) ABSTRACT

A method of bead coating a liquid composition onto the surface of a moving web is taught which provides uniform coatings over a wider range of operating parameters including new coating windows. In addition, the bead coating method typically demonstrates a reduction in coating sensitivity to vacuum pressure noise below the coating bead. The method comprises the steps of forming a bottom layer on a slide surface of a slide bead coating apparatus with a pseudoplastic liquid composition having a viscosity between 8 and 200 centipoises at a shear rate of 100 $sec^{-1}$ and a viscosity below 10 centipoises at a shear rate of 100,000 $sec^{-1}$; forming at least one other liquid coating layer above the bottom layer on the slide surface of the slide bead coating apparatus; establishing a coating bead between a lip of the slide bead coating apparatus and the moving web supported on a back-up roller, generating an electrostatic field in an air gap between the coating bead and the moving web just prior to a dynamic wetting line by creating a potential difference across the air gap of between about 300 and about 2000 volts.

23 Claims, 7 Drawing Sheets

SLIDE BEAD COATING METHOD

FIELD OF THE INVENTION

The invention relates generally to the field of coating a liquid composition onto the surface of a moving web, and, more particularly, to a method for coating a shear-thinning liquid composition onto the surface of a moving web while using an electrostatic field to assist the coating operation.

BACKGROUND OF THE INVENTION

In all liquid coating systems, there is an upper speed limit, or critical speed, for coating at which the boundary layer of air carried on the substrate surface to be coated is no longer squeezed out at the coating point but rather becomes entrained under the impinging liquid composition. This is typically referred to as air entrainment. Air entrainment can disrupt the uniform application of composition to the web substrate and can result in unacceptable uniformity of coating. Air entrainment is a gross failure and can occur in all methods for coating moving web. Air entrainment occurs predominantly at high coating speeds.

It is known to those skilled in the art that an electrostatic force of attraction between the coating liquid and the surface of the web to be coated can be used to increase coating speed. This is typically referred to as a coating operation with an electrostatic assist. With an electrostatic assist the web and/or the coating apparatus is electrostatically charged to generate an electrostatic force of attraction between the coating liquid and the surface of the web to be coated. For example, a dielectric web carrying a net voltage bias on the surface can exhibit increased apparent wettability and a consequent increase in acceptable coating speed when conveyed around a grounded coating roller. Means for applying such a charge to a web ahead of the coating point are disclosed, for example, in European Patent Nos. EP 0 390 774 B1 and EP 0 530 752 B1 and U.S. Pat. Nos. 4,835,004; 5,122,386; and 5,295,039.

In bead coating operations there are at least three other coating gross failures that may be encountered in addition to Air Entrainment. "Breaklines" (also known as low flow limit) are a running phenomenon in which a uniform, stable bead cannot be maintained, and the bead degenerates into an array of individual cells with gaps in between. This results in a crossweb array of regions of heavy coating interspersed with regions of no coating. "Pull-through" is a running phenomenon in which a portion of the composition in the bead is stripped from the underside of the bead by the stabilizing suction or vacuum pressure and is pulled down the suction drain, resulting in varying areas of thin or blotchy coating. Broad, irregularly-spaced streaks may appear in the coating at vacuum pressure levels below the vacuum pressure at which a portion of the coating composition is pulled down the drain. These streaks, which mark the onset of pull-through (also known as weeping or bleeding), are often labeled as Pull-Through, but they are also known in the art as "High Suction Streaks" (referred to herein as HSS). "Rakelines" (also known as ribbing) are a running phenomenon in which the bead assumes a regular array of alternately thick and thin areas, typically between 200 to 400 cycles per meter, resulting in a crossweb array of areas of heavy coating interspersed with areas of light coating. As observed in the process of discovering this invention, the application of electrostatic assist, while decreasing coating tendency toward Air Entrainment and Breaklines, can actually make some coatings more susceptible to Rakelines.

If the coating parameters are such that Breaklines and/or Air Entrainment may occur, then they will occur at relatively low levels of suction (vacuum pressure) and will often occur simultaneously. If the coating parameters are such that Pull-Through and/or Rakelines may occur, then they will occur at relatively high levels of suction (vacuum pressure) and may occur simultaneously. We define the "Coating Window" in terms of the range of vacuum pressure level at which "acceptable coating" can be performed. The term "acceptable coating" as used herein is intended to mean coating free of any and all gross failures defined above. The lower boundary of a coating window is the coating vacuum pressure level below which Breaklines or Air Entrainment occur. The upper boundary of a coating window is the coating vacuum pressure level above which Rakelines, high suction streaks, or Pull-Through occur. The "coating window" represents a commonly accepted measure of bead coating performance.

"Suction Noise Sensitivity" (referred to herein as Sensitivity) is the degree to which a given amplitude of suction variation or noise will modulate the thickness of the coating in the direction of the moving web. Sensitivity is also a common measure of bead coating performance, but it is less important than the Coating Window because the degree of non-uniformity induced by suction noise is usually less significant than the non-uniformity caused whenever a gross failure occurs. Sensitivity is dependent on many coating parameters, particularly the thickness of the layer(s), especially the bottom layer thickness, where a thinner bottom layer is more sensitive. Therefore, the uniformity requirements of the bottom layer may limit the thickness of the bottom layer to be greater than some minimum thickness.

It is known in the art that increasing the viscosity of compositions for coating can improve coating uniformity by increasing resistance to layer deformation by air currents both on the hopper slide and after application to a substrate. Preferably, for gelatin-based compositions, an increase in viscosity is achieved by reducing the amount of water in the composition. However, if the coating thickness is at a minimum due to sensitivity constraints, then increasing the amount of gelatin in the composition will increase the viscosity, but it is desirable to keep the gelatin fraction low (typically less than about 4%) to avoid premature reaction with other ingredients, like crosslinking agents. It is also known, however, that the bottom layer in a bead coating process, whether a single layer or the bottom layer of a multiple-layer pack, must exhibit a relatively low apparent viscosity, i.e. less than 10 centipoises and preferably less than 5 centipoises, at the point of dynamic wetting where the liquid composition first contacts the substrate surface. These requirements, that is, high viscosity under low shear conditions and low viscosity under high shear conditions, as well keeping the gelatin fraction low, may be met by formulating the bottom composition to be pseudoplastic, or non-Newtonian, by including in it an amount of a shear-thinning thickening agent. See, for example, U.S. Pat. No. 4,113,903 issued Sep. 12, 1978 to Choinski, the relevant disclosure of which is hereby incorporated by reference. Such agents are well known in the art of coating compositions, and may include, but are not limited to, sodium cellulose sulfate and other salts of cellulose; copolymers of methyl vinyl ether and maleic anhydride; salts of polyvinyl hydrogen phthalate; polystyrene sulfuric acid; sodium poly(styrenesulfonate); and sulfonated vinyltoluene polymers. It is known in the art that removing gelatin and adding shear-thinning thickening agents can increase the maximum coating speed permissible without Air Entrainment. However, chemical incompatibilities with some layer ingredients may prevent the use of those shear-thinning thickening agents that meet the preferred requirement of 5 centipoises at 10,000 $sec^{-1}$, thus limiting the speed permissible without Air Entrainment and increasing the potential for Breaklines.

SUMMARY OF THE INVENTION

It is therefore an object of the present invention to provide an improved coating method whereby coatings having improved thickness uniformity may be made.

It is a further object of the invention to provide an improved coating method whereby the coating speed for uniform coatings may be increased.

It is a still further object of the invention to provide an improved coating method whereby the size of the Coating Window is increased.

It is a still further object of the invention to provide an improved coating method whereby the rheological constraints on formulation of the bottom layer are relaxed.

It is a still further object of the invention to provide an improved coating method whereby the total wet thickness for uniform coatings may be reduced.

It is a still further object of the invention to provide an improved coating method whereby the wet thickness of the bottom layer, which usually contains an excess of water for uniform coatings, may be reduced.

It is a still further object of the invention to provide an improved coating method whereby an increased tendency of a coating composition to form Rakelines in the presence of electrostatic coating assist is reduced.

Briefly stated, the foregoing and numerous other features, objects and advantages of the present invention will become readily apparent upon a review of the detailed description, claims and drawings set forth herein. These features, objects and advantages are accomplished by employing shear-thinning thickening agents in the bottom layer in a bead coating process thereby yielding a pseudoplastic bottom or carrier layer. Simultaneously, an electrostatic field is generated at the coating point to provide an electrostatic force of attraction between the coating liquid and the surface of the web to be coated. The combination of these two independent method steps unexpectedly provides uniform coatings at higher speeds and with greater coating stability than can be achieved with either step practiced independently.

More particularly, in a first step of the method of the present invention, the liquid composition is formulated as a pseudoplastic liquid having a viscosity of at least about 8 centipoises at a shear rate of 100 $sec^{-1}$ and a viscosity below 10 centipoises at a shear rate of 100,000 $sec^{-1}$, and preferably between 8 and 200 centipoises at a shear rate of 100 $sec^{-1}$ and a viscosity below 5 centipoises at a shear rate of 10,000 $sec^{-1}$. One class of Theological fluids meeting these requirements have a consistency m>50 and a flow behavior index n<0.7 and a viscosity substantially given by $$\eta=m(d\gamma/d\tau)^{n-1} \quad \text{(Eq. 1)}$$

where $\eta$ is viscosity and $d\gamma/d\tau$ is the shear rate. The liquid composition may comprise a single-layer coating or may be the bottom composition of a plurality of superposed compositions forming a multiple-composition coating pack for forming a multiple-layer coating. Then, in a subsequent step of the present invention, an electrostatic field is applied between the coating bead of liquid composition and the web surface to be coated such that the coating bead is attracted to the surface, forming a uniform coated layer of the composition thereupon.

The method of the present invention increases the range of permissible coating parameters, such as speed, wet thickness, and viscosity, without incurring any gross failures, while also increasing the resistance of coating to otherwise inherent coating process non-uniformities.

DETAILED DESCRIPTION OF THE INVENTION

Figure 1A:
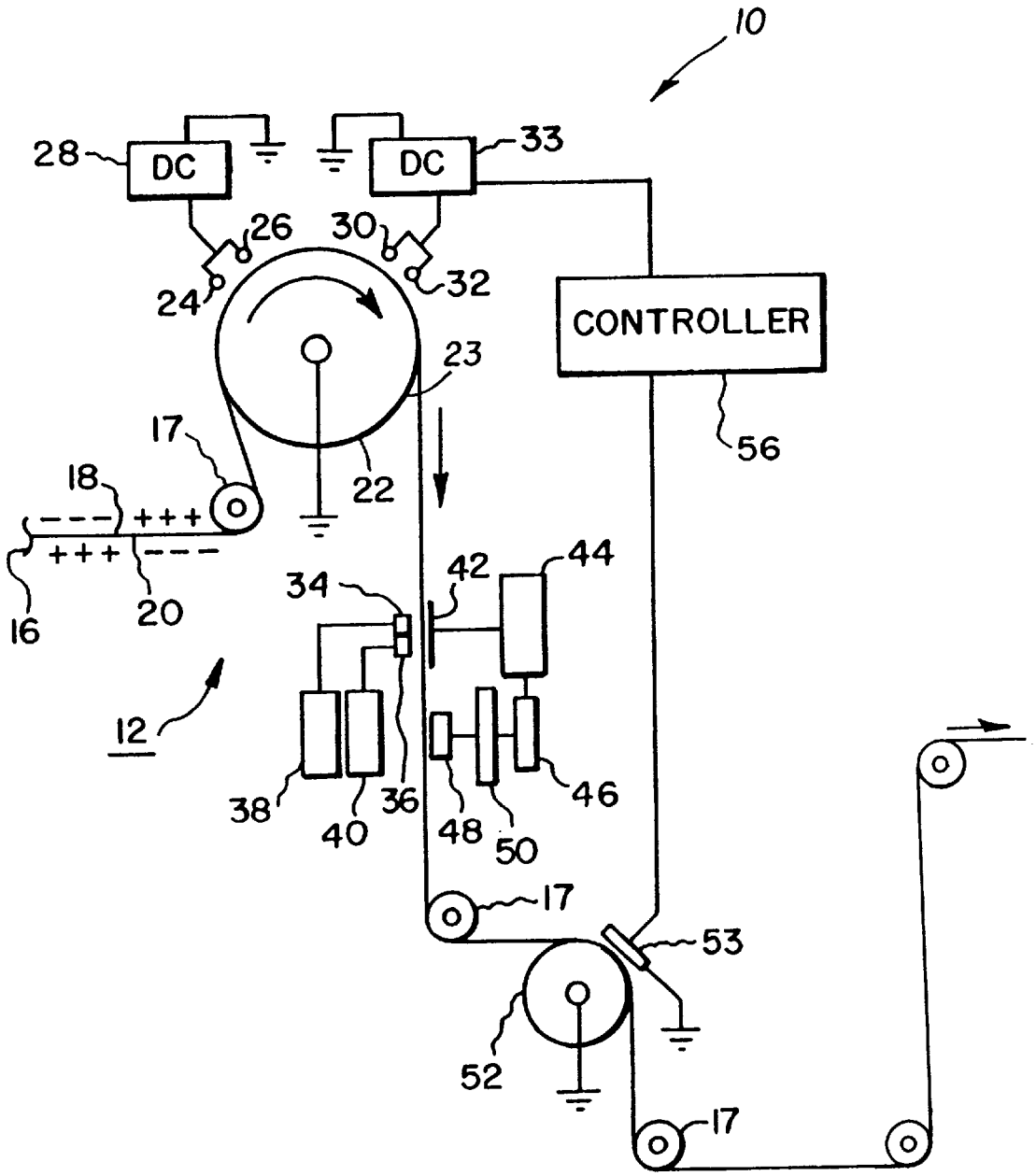
FIGS. 1A and 1B are a schematic of an apparatus that can be used to practice the method of the present invention.
Figure 1B:
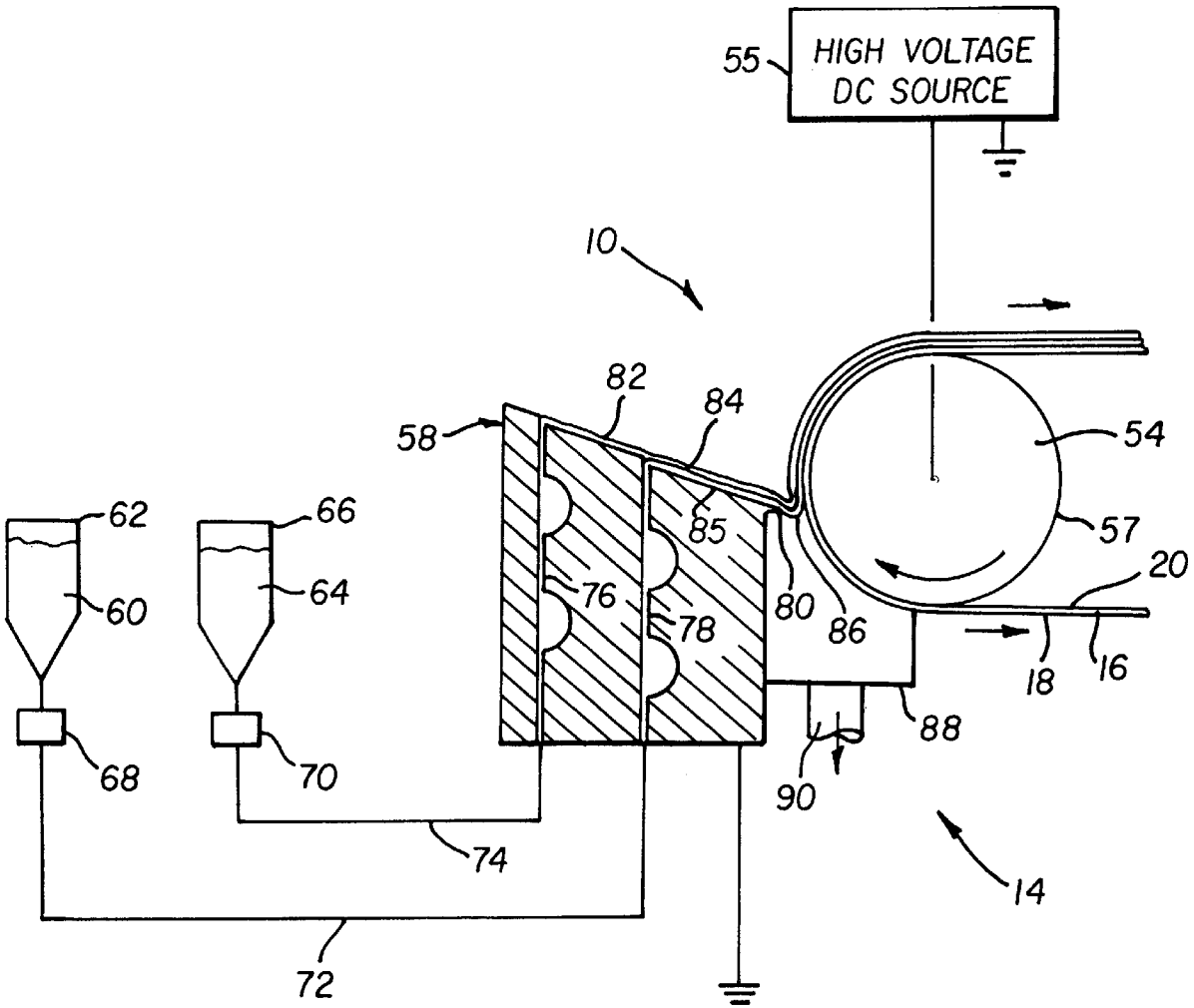

Turning first to FIGS. 1A and 1B, there are shown schematics of an apparatus 10 that can be used to practice the method of the present invention. Electrostatic coating assist may be provided by section 12 without electrification of section 14, or by electrification of section 14 without installation or use of section 12, or preferably by use of sections 12 and 14 together, as described below. The common element among these methods and apparatus configurations is the generation of an electrostatic field in the air gap between the coating bead and the web just prior to the coating point (more accurately described as the dynamic wetting line) as will be described hereinafter in greater detail. This may be achieved, although not necessarily with equal quality results, by either a) electrifying the web ahead of the coating point so that the web carries a charge into section 14; or b) by electrifying the coating apparatus in section 14 to provide the desired field at the coating point; or, c) by a combination of a) and b). Preferably, a voltage differential greater than about 300 volts is used to generate the electrostatic field in the air gap between the coating bead and the web just prior to the coating point. In a preferred embodiment, described in detail below, the web is first electrified and then completely neutralized in section 12, so that the field providing electrostatic assist for coating derives only from the electrification in section 14.

In a presently preferred embodiment, a continuous web 16 having first and second surfaces 18, 20, is supplied to section 12 from a conventional unwinding and conveyance apparatus (not shown) and may be conveyed conventionally through the apparatus on generic rollers 17. Web 16 may be formed of any substantially non-conductive material including, but not limited to, plastic film, paper, resin-coated paper, and synthetic paper. Examples of the material of the plastic film are polyolefins such as polyethylene and polypropylene; vinyl copolymers such as polyvinyl acetate, polyvinyl chloride, and polystyrene; polyamide such as 6,6-nylon and 6-nylon; polyesters such as polyethylene terephthalate, and polyethylene-2 and -6 naphthalate; polycarbonate; and cellulose acetates such as cellulose diacetate and cellulose triacetate. The web may carry one or more coats of subbing material on one or both surfaces. The resin employed for resin-coated paper is typically a polyolefin such as polyethylene.

Web 16 may have patches of electrostatic charges disposed randomly over one or both surfaces 18, 20. In Section 12, charges on the web are adjusted. When section 14 is not electrified, the web in section 12 is provided with a residual charge of at least about 300 volts as measured by induction probe 53 at the exit of section 12. Various methods and apparatus known in the art, including but not limited to those disclosed in the patents recited hereinabove, may be suitable for charge modification in section 12 in accordance with the invention.

In an embodiment presently preferred for both plastic and paper webs, both sections 12 and 14 are provided, section 12 being used as follows. Web 16 is wrapped and conveyed around a grounded, conductive backing roller 22 with web surface 20 in intimate contact with the conductive surface 23 of roller 22. Web surface 18 is exposed to negatively charged electrodes 24, 26 which "flood" a large amount of negatively charged particles onto surface 18. Electrodes 24, 26 may be electrically connected to the negative terminal of an adjustable 0–20 kV, 0–15 mA source 28 of DC potential. Grounded roller 22 acts as a counter electrode for electrodes 24, 26.

As web 16 is advanced along roller 22, it moves beneath electrodes 30, 32 which may be electrically connected to the positive terminal of a DC potential source 33 similar to source 28. Electrodes 30, 32 deposit a large amount of positively charged particles onto web surface 18 which neutralize the negative charge previously imparted to this surface by electrodes 24, 26. Grounded roller 22 functions as a counter electrode for electrodes 30, 32.

It will be understood by those skilled in the art that the polarity of electrodes 24, 26 and 30, 32 may be reversed such that web surface 18 is "flooded" first with a large amount of positive charges and subsequently neutralized with a large amount of negative charges.

Web 16 is further conveyed about grounded roller 52 so that web surface 20 is in intimate contact with roller 52, the opposing web surface 18 being exposed to an induction probe 53 of a feedback control system comprising probe 53 and controller 56, which controller is responsive to the level of charge sensed by probe 53 and may be programmed to automatically adjust the level of charge applied by DC source 33 to electrodes 30, 32 to control the steady-state residual charge on surface 18 at any desired value. When section 14 is being electrified in addition to section 12 in accordance with the preferred embodiment of the invention, controller 56 is programmed to provide a residual voltage at probe 53 near or at zero.

The just-described electrostatic web treatment typically is sufficient to completely discharge all charges on surface 18 of the web and some of the charge on surface 20. However, some webs may retain some residual charge on surface 20 which may also be removed.

After leaving roller 22, web 16 may be conveyed past two fixed voltage or fixed DC current ionizers 34, 36 which are mounted near and facing surface 20 of web 16 on a free span of travel. The ionizers 34, 36 are mounted so that the central axis of each ionizer is oriented parallel to the web and transverse to the direction of travel of the web. Each ionizer is electrically connected to a separate DC high voltage power supply 38, 40. A conductive plate 42 which is electrically isolated from ground is positioned opposite ionizers 34, 36 and facing surface 18 of web 16. Plate 42 can be of various shapes, designs, constructions, or materials, including both solid materials and screens, but plate 42 must incorporate at least a layer of conductive material to act as an equipotential surface to attract charge from ionizers 34, 36. A controllable bipolar high voltage source 44 is electrically coupled to plate 42 to deliver voltage to the plate over a wide range of positive and negative voltages (+/−5 kV). A feedback control system 46 may have a sensor or sensor array 48 responsive to the mean charge density residual on the web after treatment by the ionizers. Source 44 may be adjusted manually to adjust the voltage level on plate 42 so that the plate voltage increases in the same polarity as a direct function of the residual charge density on the web; preferably, such adjustment is controlled automatically by electronic controller 50 to minimize the steady-state residual free charge on the web, preferably near or at zero.

Figure 2:
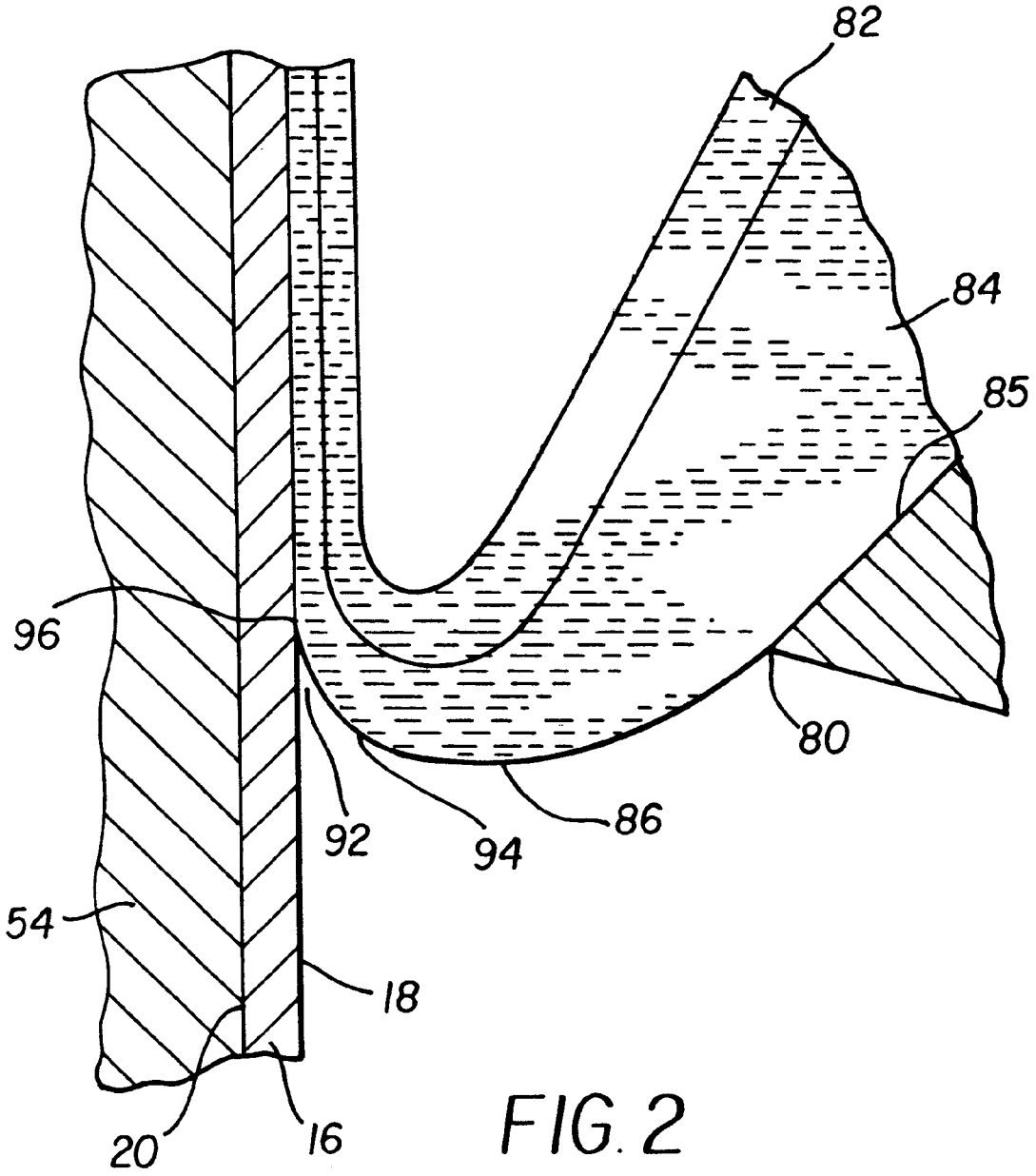
FIG. 2 is an enlarged view of the coating bead formed in the gap between the hopper lip and the web supported on the backing roller.

As shown in FIG. 1, B in section 14 web 16 is entered upon and wrapped partially around a backing roller 54, the angle of wrap including the coating point 96 (actually a coating line see FIG. 2). Roller 54 is preferably electrically isolated and may be electrically connected to a high voltage DC source 55 to place a high potential on the surface 57 of backing roller 54, for example, 300 V, creating a standing electric field around roller 54. Slide bead coater 58 is electrically grounded. Slide bead coater 58 can simultaneously apply one or more coating composition layers to the moving web 16. For simplicity, the exemplary slide bead coater 58 depicted shows only the application of two coating layers. There is a first coating composition 60 in a first supply vessel 62 and a second coating composition 64 in a second supply vessel 66. First and second delivery systems 68, 70 regulate the flow of the liquid compositions 60, 64 from the vessels 62, 66 through first and second delivery lines 72, 74 to first and second distribution passageways 76, 78 of a slide hopper 58. Web substrate 16 is conveyed on a surface 20 thereof around a backing roller 54. Hopper 58 is provided with a lip 80, and backing roller 54 and lip 80 are positioned to form a gap therebetween. Composition 64 is superposed as a layer 82 on layer 84 formed by composition 60 by slide hopper 58 to form a liquid two-layer composite. The two-layer composite flows under gravity down hopper slide surface 85, over lip 80, and onto surface 18 of web 16, forming a continuous, dynamic, hydraulic bead 86 bridging the gap between lip 80 and web 16 (shown in an enlarged view in FIG. 2). The bead 86 is stabilized by application of suction (vacuum pressure) to the underside of the bead in a close-fitting vacuum box 88 connected to a regulatable vacuum source via conduit 90.

It should be understood by those skilled in the art that the present invention has advantages over the prior art in both single coating and multiple layer composite coating applications. Thus, the term "bottom layer" as used herein is intended to mean that one layer of a single layer coating, or that layer of a multiple layer composite that is intended to actually contact and wet the web continuously after start-up. In other words, even in a single layer coating operation, the single layer is referred to herein as the "bottom layer". Any layers above the "bottom layer" are considered upper layers in a multiple layer composite. It should also be understood that a multiple layer composite may include a bottom layer and one or more upper layers which are differentiated only by some physical property such as, for example, surface tension. Thus, the bottom layer and one or more upper layers may have the same rheology. For the purposes of this application, the bottom layer and the one or more upper layers having the same rheology are still considered to be separate layers.

An electrostatic field is created between the coating layers 82, 84 and surface 18 of web 16 at the coating point via deposition of charge uniformly on surface 18, preferably with an electric potential between 300 volts and 2000 volts, the polarity of which may be either positive or negative. This charge may be deposited on the web either by sections 12 or 14 as described above, or by any of several known apparatus and methods, for example, as disclosed in PCT International Publication No. WO 89/05477. In the preferred embodiment, an electrostatic field is created between the coating layers 82, 84 and surface 18 of web 16 at the coating point by establishing a potential difference between the hopper lip 80 and the backing roller 54. The electrostatic field in the gap 92 between the bead 86 and the surface 18 of the web 16 yields an electrostatic force acting on the lower surface 94 of the bead 86 proximate to the dynamic wetting line 96. This electrostatic force acting on the lower surface 94 of the bead 86 is the electrostatic assist to the coating operation.

At the dynamic wetting line 96 (sometimes referred to herein as the coating point) the surface 18 must be substantially non-conductive to allow sufficient electrostatic field strength between surface 18 and bead 86. By substantially non-conductive it is meant that the characteristic electrical length $\lambda$ should be less than about 400 $\mu$m, preferably less than 100 $\mu$m, where $\lambda$ is defined as by the relationship $$\lambda = [\rho_s CU]^{-1}$$

where $\rho_s$ is the web surface resistance on the side to be coated (ohms/square), C is the web capacitance per unit area while on the coating roller (F/m$^2$), and U is the web speed (m/s) as discussed in U.S. Ser. No. 09/408,221.

The surface 18 may be of higher or lower resistivity (shorter or longer characteristic electrical length) at points other than the coating point. The surface 20 preferably has a surface resistivity greater than about $10^6$ ohm per square to facilitate electrical isolation of the coating roller from neighboring rollers in contact with surface 20. The surface 20 preferably has a surface resistivity less than about $10^9$ ohm per square to reduce non-uniformity of the electrostatic field due to incomplete contact of surface 20 with the coating roller 54.

In passing through the bead 86, the layers 82, 84 undergo a very high shear as the layers 82, 84 are stretched by being accelerated, typically several hundred fold, from a velocity of a few centimeters per second on the slide surface to a velocity of, typically, several meters per second on the web surface, which may correspond to a shear rate in the range of $10^4$ to $10^6$ reciprocal seconds. Shear rates on the slide surface 85 before coating and on the web surface after coating are typically below about 100 reciprocal seconds.

It is known in the coating art that the bottom or carrier layer 84 of a bead coating pack is benefited by having a low apparent viscosity, for example, less than about 10 centipoises and preferably less than about 5 centipoises, in order to promote wetting of the web 16. Typically, this is achieved by dilution of the bottom or carrier layer 84 with an appropriate solvent, for example, water for gelatin-based compositions such as photographic emulsions. However, to increase coating speeds for greater manufacturing efficiency, it is desirable to concentrate compositions in order to achieve proper setting and drying in shorter periods of time. Also, it is desirable to have high apparent viscosity on the hopper slide surface 85 and on the web 16 after coating, both areas of low shear, to avoid the occurrence of coating non-uniformities due to flow instabilities on the slide surface 85 or on the web 16. Many coating compositions, such as photographic emulsions, are substantially Newtonian in rheology such that concentrating the bottom or carrier layer by removing water/solvent increases undesirably, and in the extreme unacceptably, the apparent viscosity experienced in the bead. The size of the Coating Window may be decreased, and the coating pack can become more sensitive to perturbations in the vacuum pressure under the bead 86. Thus, it is known in the coating art to add addenda to bottom layer compositions 60 to make them significantly less Newtonian, or more "pseudoplastic." Such addenda are referred to as "shear-thinning thickeners," and such compositions have the property of having maximum apparent viscosity at conditions of low shear, for example, 100 sec$^{-1}$, and much lower apparent viscosity at conditions of high shear, for example, 10,000 sec$^{-1}$ or higher.

The amounts of shear-thinning thickener agent employed in bottom layer 84 are chosen to produce the desired low viscosity, of less than ten (10) centipoises, and preferably less than about five (5) centipoises, at shear rates in the higher range of those to be encountered at the dynamic wetting line 96 on the web 16, and a desirable high viscosity (from 8 to 200 centipoises) at low shear rates. The data required to determine the suitability of given shear-thinning thickener can be determined by a few measurements with a rheometer at different shear rates in concentrations of shear-thinning thickener in the chosen vehicle.

Thus, it is known to apply an electrostatic field at the coating point between the coating liquid and web surface to be coated to decrease the tendency to entrain air between the bead and the web, thereby permitting an increase in coating speed. It is further known to add shear-thinning thickeners to compositions to permit high apparent viscosity on the slide and on the web while maintaining low apparent viscosity in the coating bead. It is further known to add shear-thinning thickeners to concentrated compositions to permit removal of gelatin such as to maintain the high apparent viscosity on the slide and on the web, while achieving a low apparent viscosity in the coating bead, therefore permitting an increase in coating speed. However, it has now been unexpectedly found that the combination of these two disparate technologies as part of an integrated slide bead coating process yields significant advantages over a bead coating operation that includes only the use of electrostatic assist or only the use of shear-thinning thickeners. Specifically, it has been surprisingly discovered that the size of the coating window is significantly increased and/or additional coating windows are created when electrostatic assist and shear-thinning thickeners are used in combination in a slide bead coating process. Further, sensitivity to perturbations such as those perturbations caused by vacuum pressure noise is markedly decreased when electrostatic assist and shear-thinning thickeners are used in combination in a slide bead coating process.

The benefits of the present invention may be demonstrated by several examples.

EXAMPLE 1

A two-layer coating composition pack comprising gelatin-based aqueous emulsions was coated using the apparatus shown in FIG. 1. Examples of coating layer 84, formulated with and without, respectively, TL-132, a form of sodium poly (styrene sulfonate) available from National Starch and Chemical located in Bridgewater, N.J., contain 3% dyed gelatin, and have an apparent viscosity of 8 centipoises at 100 $sec^{-1}$ and 2.8 centipoises at 10,000 $sec^{-1}$. The composition of coating layer 82 was a conventional gelatin overcoat which contains no shear-thinning polymer, contains 13% gelatin, 0.067% TX-200E surfactant, and has an apparent viscosity of 38 centipoises at 100 $sec^{-1}$. Coating speed was 1000 feet per minute. Wet coated thickness of each of coating layers 82 and 84 was 28 $\mu$m, resulting in a total thickness of 56 $\mu$m. The formulation of upper layer 82 is constant for all example coatings. The web substrate 16 was polyethylene terephthalate of thickness 100 micrometers. The web was fully discharged before coating, and a voltage was applied to the backing roller 54 to establish an electrostatic field in the gap 92 between the bead 86 and the web surface 18 at the dynamic wetting line 96.

A full factorial of two-layer coatings was made: with and without shear-thinning thickener in layer 84; at zero, 400, and 800 volts ESA; and over a vacuum pressure range from 500 to 0 Pascal, in increments of 25 Pascal. A minimum vacuum pressure level, in which the coating is free of gross failure (typically Breaklines and Air Entrainment) and similarly a maximum vacuum pressure level free of gross failure (typically Pull-Through, HSS, or Rakelines) are used in defining the size of the Coating Window. Density traces to determine thickness variability in the direction of coating are made to assess Sensitivity.

Figure 3:
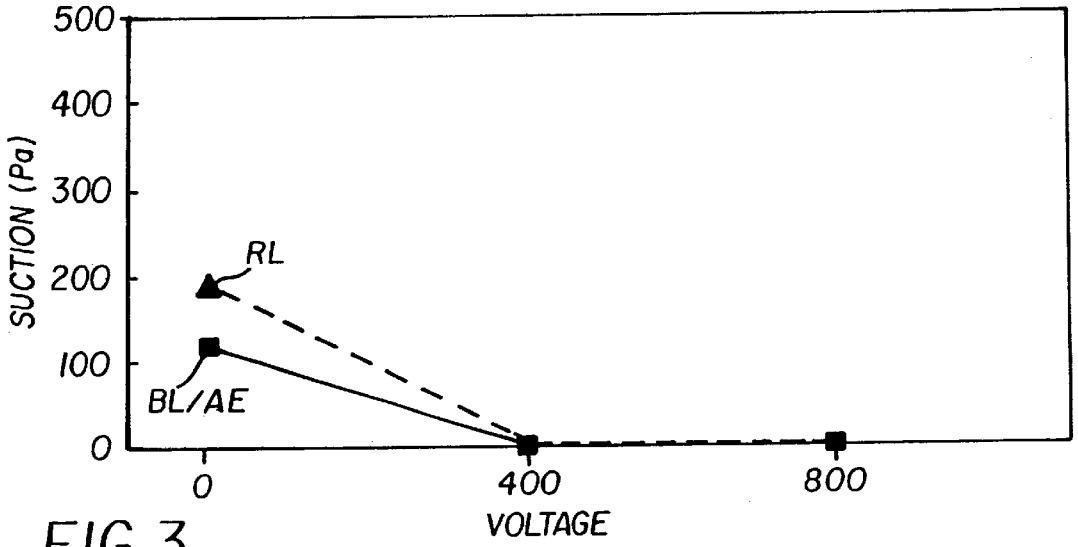
FIG. 3 is a is a graph plotting vacuum pressure under the coating bead as a function of electrostatic potential difference between the bead and the coating roller for Example 1 showing lack of a Coating Window obtainable when coating at 1000 feet per minute an aqueous gelatin composition of two layers, wet thickness of 28 $\mu$m per layer, the bottom layer having a low-shear viscosity of 8 centipoises formulated without a shear-thinning thickener, the uppermost layer having a low-shear viscosity of 38 centipoises.

Results are shown in FIGS. 3–6. Referring to FIG. 3 (the base case), vacuum pressure under the coating bead has been plotted against voltage level for Example 1 wherein the bottom layer 84 contains gelatin and no shear-thinning thickener. As indicated in FIG. 3, no Coating Window is achieved, despite application of electrostatic assist (ESA) at 400 and 800 volts. ESA eliminates Breaklines (BL) and Air Entrainment (AE) gross failures but also causes unacceptable Rakelines (RL) such that there is no usable Coating Window free of gross failure.

Figure 4:
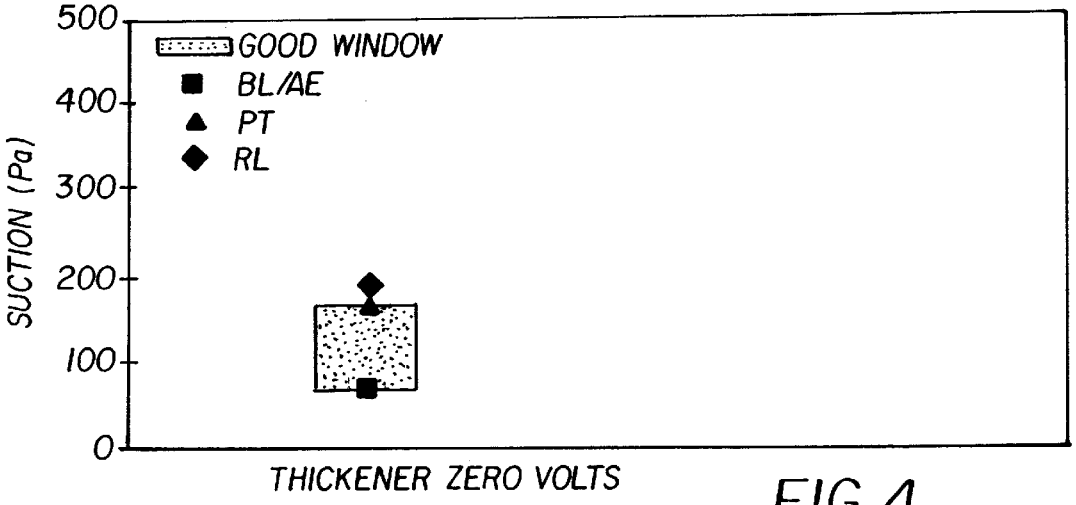
FIG. 4 is a graph plotting vacuum pressure under the coating bead as a function of 0 electrostatic potential difference between the bead and the coating roller for Example 1 with the addition of a shear-thinning thickener to the bottom layer in accordance with the prior art.

Referring to FIG. 4, vacuum pressure under the coating bead has been plotted at a zero voltage level for Example 1, wherein the bottom layer 84 contains gelatin and a shear-thinning thickener. The addition of shear-thinning thickener to the composition of layer 84 provides a modest but useful Coating Window between vacuum pressure levels of about 60 Pascal and about 160 Pascal without any ESA, as expected from the prior art.

Figure 5:
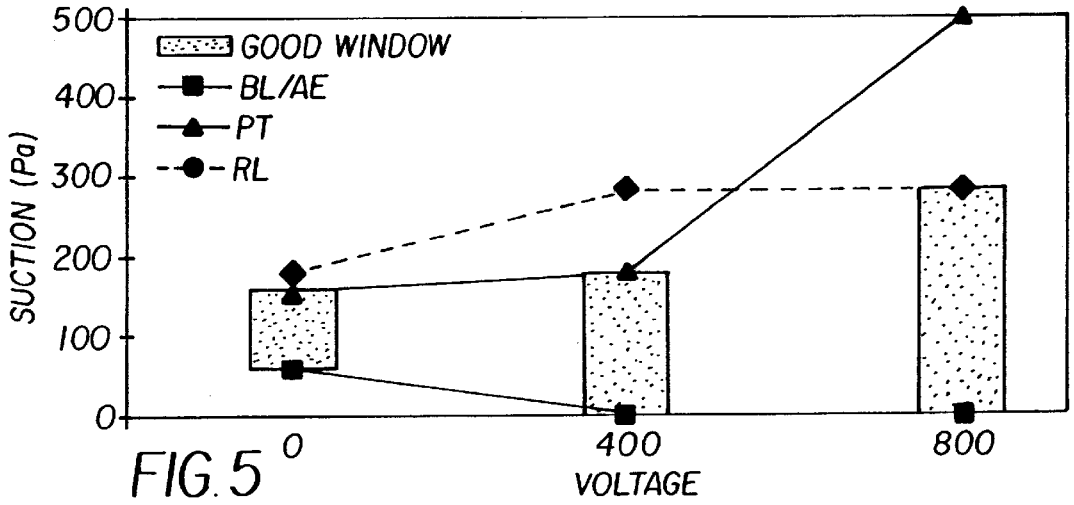
FIG. 5 is a graph plotting vacuum pressure under the coating bead as a function of electrostatic potential difference between the bead and the coating roller for Example 1 with the addition of a shear-thinning thickener to the carrier layer showing the creation of additional Coating Windows by the method of the present invention.

Referring to FIG. 5, vacuum pressure under the coating bead has been plotted against voltage levels 0 volts, 400 volts, and 800 volts for Example 1, wherein the bottom layer 84 contains gelatin and a shear-thinning thickener. It is seen that combining the two independent technologies, as demonstrated in FIGS. 3 and 4, in accordance with the present invention unexpectedly provides a larger coating window at both 400 volts and 800 volts than is possible using either of the technologies alone. In fact, coating windows become available at 400 volts and at 800 volts where no coating window at such voltages previously existed using ESA without a shear-thinning thickener in the carrier or bottom layer. The combination eliminates Breaklines (BL) and Air entrainment (AE) as seen previously with ESA only (FIG. 3), but in addition Pull-Through (PT) is eliminated over the range of suction tested and the combination also raises dramatically the minimum vacuum pressure level at which Rakelines (RL) appear, such that the entire Coating Window can exist below the onset of Rakelines.

Figure 6:
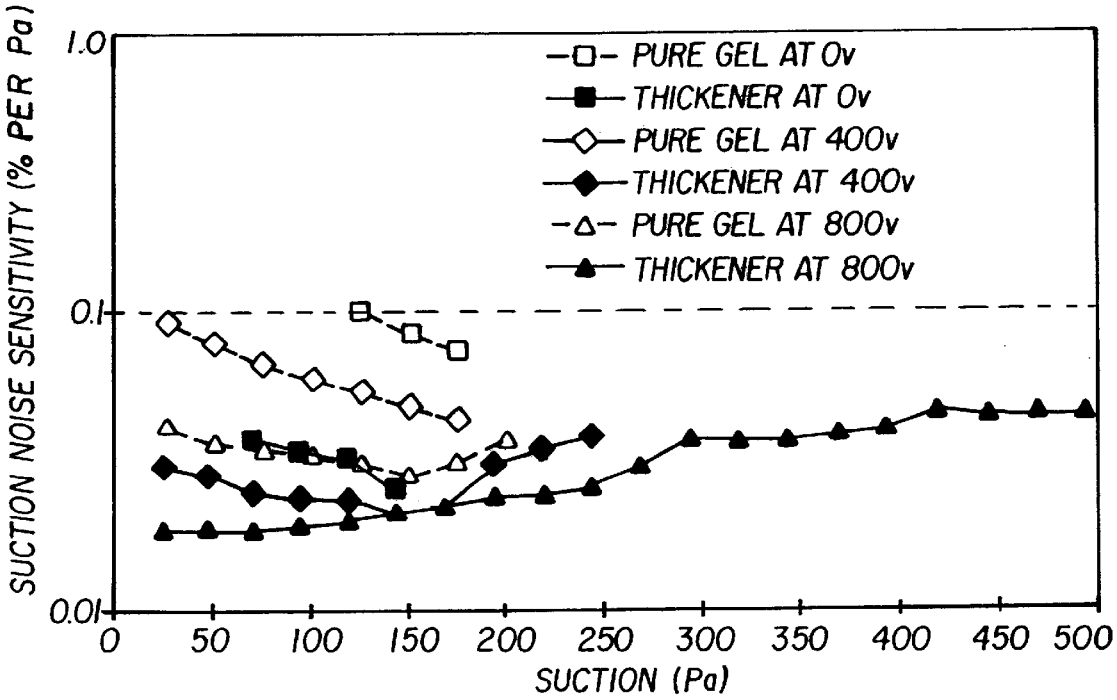
FIG. 6 is a graph wherein vacuum noise sensitivity is plotted as a function vacuum pressure under the coating bead for each of the variations of Example 1.

Referring to FIG. 6, vacuum noise sensitivity is plotted against vacuum pressure under the coating bead for each of the variations of Example 1. It is seen that the combination of the present invention also unexpectedly reduces vacuum noise sensitivity below that obtainable with either the use of ESA alone or the use of a shear-thinning thickener alone.

EXAMPLE 2

The conditions of Example 1 are repeated except that the apparent viscosity of the composition of layer 84, with and without shear-thinning thickener, is increased to 18 centipoises at 100 $sec^{-1}$.

Figure 7:
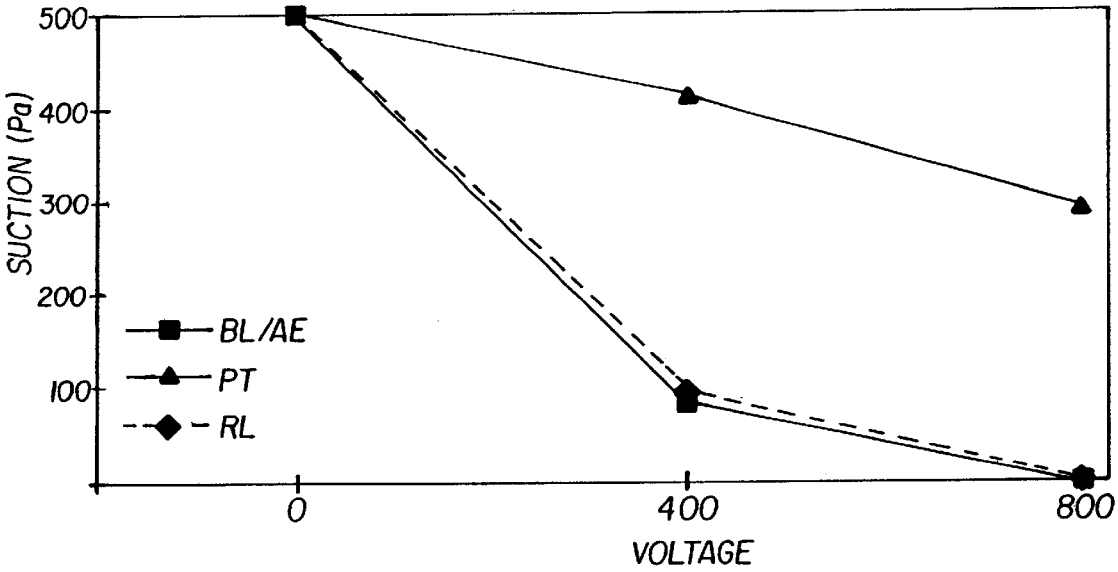
FIG. 7 is a graph plotting vacuum pressure under the coating bead as a function of electrostatic potential difference for Example 2 wherein the bottom layer contains gelatin and no shear-thinning thickener and has a low-shear viscosity of 18 centipoises.

Referring to FIG. 7, vacuum pressure under the coating bead has been plotted against voltage level for Example 2 wherein the bottom layer 84 contains gelatin and no shear-thinning thickener. As indicated in FIG. 7, no Coating Window is achieved, despite application of electrostatic assist (ESA) at 400 and 800 volts because of Breaklines (BL) and Air Entrainment (AE) without ESA (0 volts) and because of Rakelines (RL) at 400 and 800 volts.

Figure 8:
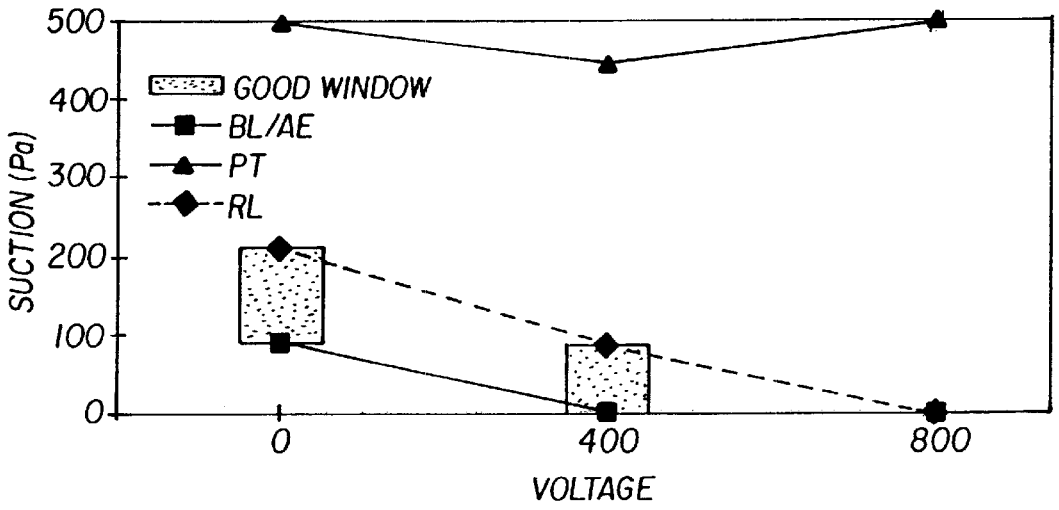
FIG. 8 is a graph plotting vacuum pressure under the coating bead as a function of electrostatic potential difference for Example 2 wherein the bottom layer contains gelatin and a shear-thinning thickener and has a low-shear viscosity of 18 centipoises.

Referring to FIG. 8, vacuum pressure under the coating bead has been plotted against voltage level for Example 2, wherein the bottom layer 84 contains gelatin and a shear-thinning thickener. Adding a shear-thinning thickener to the composition of layer 84 yields an acceptable coating window at 0 and 400 volts ESA, but no window at 800 volts. Thus, the combination of ESA and a shear-thinning thickener resulted in creation of a coating window at lower vacuum pressures that did not exist with ESA alone or a shear-thinning thickener alone. The advantages of coating with lower vacuum pressures are lower vacuum noise that may reduce coating nonuniformity and simplification of the coating operation if acceptable coating is possible without the aid of suction.

EXAMPLE 3

The compositions for layers 82 and 84 used in Example 2 are coated at a lower speed (400 feet per minute) and at a very low bottom layer 84 thickness (10 $\mu$m). The overcoat composition of layer 82 has an increased coating thickness (46 $\mu$m) to maintain the same total coating thickness as in Example 2 (56 $\mu$m).

Figure 9:
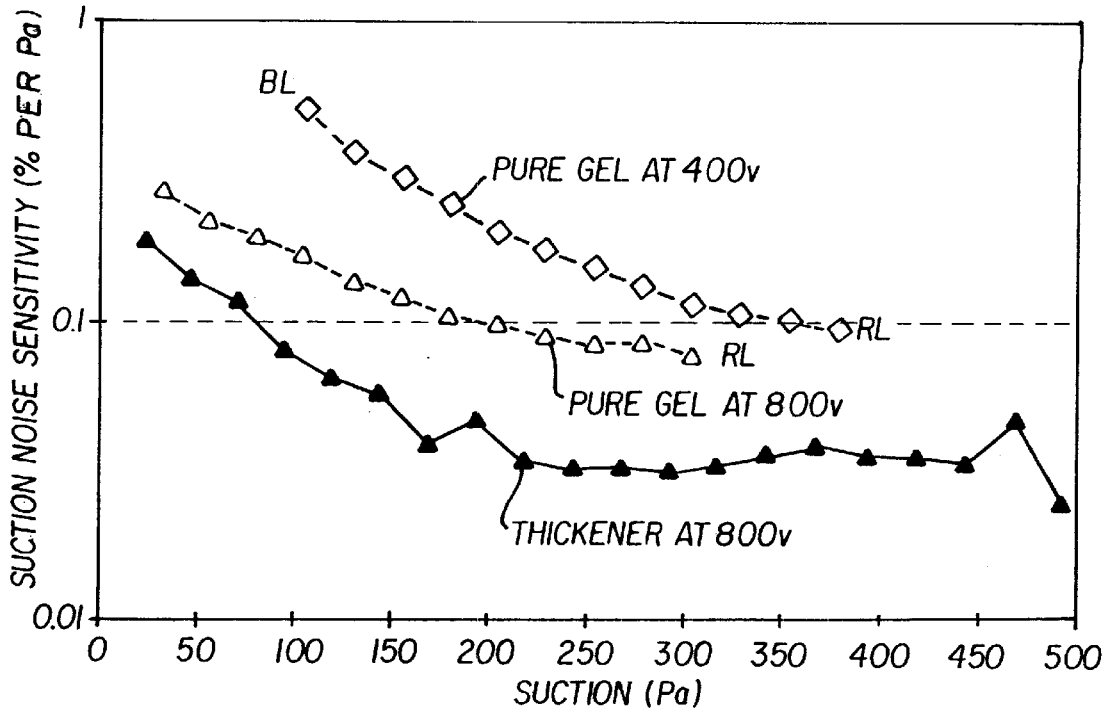
FIG. 9 is a graph of vacuum pressure noise sensitivity as a function of vacuum pressure for the data gathered from Example 3 wherein the bottom or carrier layer wet thickness was 10 $\mu$m, the viscosity of the carrier layer was 18 centipoises, the uppermost layer thickness was 46 $\mu$m, and coating was performed at a web speed of 400 feet per minute.

Referring to FIG. 9 vacuum pressure noise sensitivity is plotted against vacuum pressure for the data gathered from Example 3. In both instances where there was no application of ESA (0 volts), that is, with and without a shear-thinning thickener in the composition of layer 84, Breaklines were present throughout the vacuum pressure range, resulting in no good Coating Window and no measure of vacuum pressure Sensitivity. Therefore, no curves are shown for FIG. 9 for the 0 volt cases of Example 3. The coatings of Example 3 using ESA provide an acceptable range of good coating (although no data was taken with a shear-thinning thickener at 400 volts). The composition of layer 84 a with shear-thinning thickener with ESA of 800 volts (black triangles) is preferred over either of the pure gel coatings (open diamonds and open triangles) because of a surprising reduction in vacuum pressure noise sensitivity. Also the coating window is limited by Rakelines (RL) when using ESA with pure gel, while the coating window is free of Rakelines when using the combination of ESA and a shear-thinning thickener in the composition of layer 84.

EXAMPLE 4

The compositions of layers 82 and 84 used in Example 2 are coated at a higher speed (1250 feet per minute) and a very low bottom layer 84 thickness (10 $\mu$m). The coverage of overcoat composition 82 is increased (182 $\mu$m).

Figure 10:
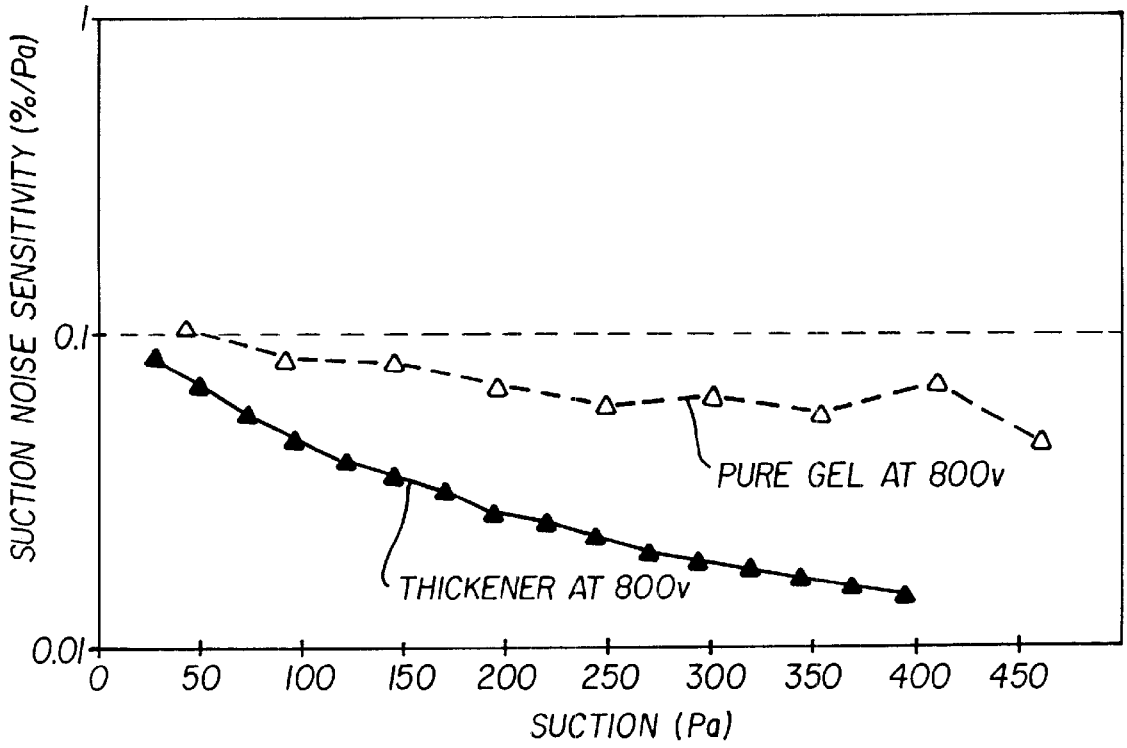
FIG. 10 is a graph plotting vacuum pressure noise sensitivity as a function of vacuum pressure under the coating bead for the results of Example 4 wherein the bottom or carrier layer wet thickness was 10 $\mu$m, the viscosity of the carrier layer was 18 centipoises, the uppermost layer thickness was 182 $\mu$m, and coating was performed at a web speed of 1250 feet per minute.

Referring to FIG. 10, vacuum pressure noise sensitivity is plotted against vacuum pressure for the results of Example 4. All of the 0 volt and 400 volt ESA coatings had Air Entrainment throughout the vacuum pressure range. As a result, no coating window was achieved and therefore, there was no measure of vacuum pressure sensitivity. Both compositions of layer 84 with (black triangles) and without (open triangles) shear-thinning thickener exhibit an excellent coating window when an ESA of 800 volts is applied, but the combination of using both a shear-thinning thickener and ESA in accordance with the present invention is significantly less sensitive to vacuum pressure noise at all levels of vacuum pressure tested.

EXAMPLE 5

The conditions of Example 1 are coated at a lower speed (700 feet per minute) except that the apparent viscosity of the composition of layer 84, with and without shear-thinning thickener, is increased to 60 centipoises at 100 $sec^{-1}$. The overcoat composition of layer 82 has an increased coating thickness (36 $\mu$m) to increase the total coating thickness (64 $\mu$m).

Figure 11:
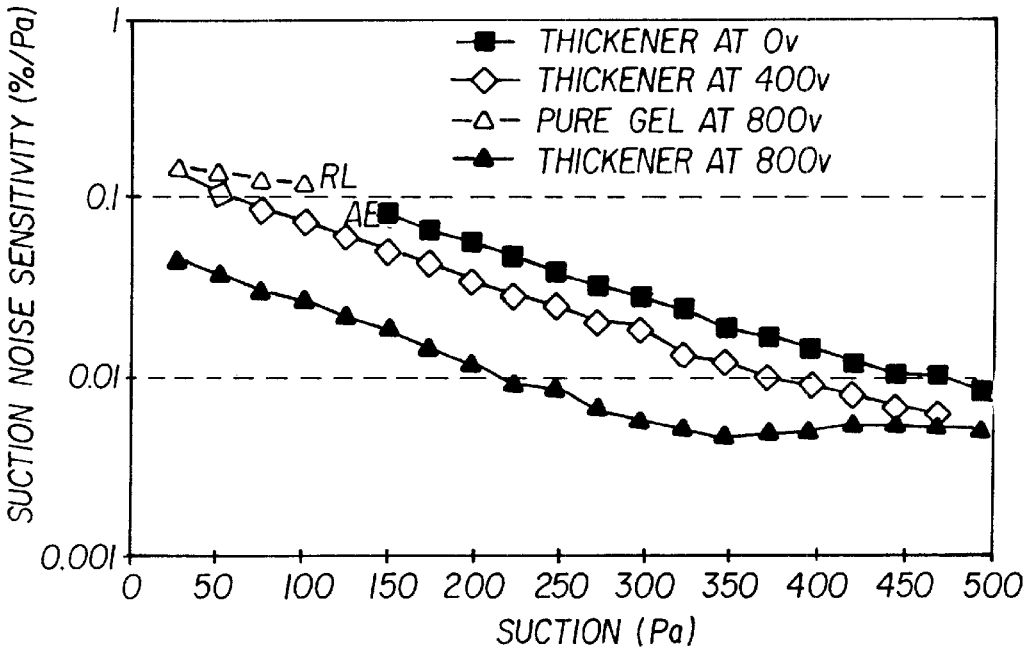
FIG. 11 is a graph plotting vacuum pressure noise sensitivity as a function of vacuum pressure under the coating bead for the results of Example 5 wherein the bottom or carrier layer wet thickness was 28 $\mu$m, the viscosity of the carrier layer was 60 centipoises, the uppermost layer thickness was 36 μm, and coating was performed at a web speed of 700 feet per minute.

Referring to FIG. 11, vacuum pressure noise sensitivity is plotted against vacuum pressure for the results of Example 5. For the composition of layer 84 without shear-thinning thickener, both the 0 volt and 400 volt ESA coatings had Air Entrainment throughout the vacuum pressure range. As a result, no coating window was achieved and therefore, there was no measure of vacuum pressure sensitivity. The 800 volt ESA coating (open triangles) had a small coating window that was limited by Rakelines (RL). For the composition of layer 84 with shear-thinning thickener, the 0 volt coating (black squares) had a coating window that was limited by Air Entrainment (AE) at low vacuum pressure. However once again, the combination of using both a shear-thinning thickener and ESA in accordance with the present invention exhibited an excellent coating window with significantly less sensitivity to vacuum pressure noise at all levels of vacuum pressure tested.

Those skilled in the all will recognize that the use of "vacuum pressure" below the coating bead is the preferred method of creating a pressure differential such that the pressure below the coating bead 86 is less than the pressure above the coating bead 86. Typically, this is accomplished by positioning a vacuum box or manifold to generate a subatmospheric pressure below the coating bead 86. With the pressure above the coating bead 86 typically being atmospheric, the small pressure differential above and below the coating bead 86 aids in stabilizing the bead 86 in the gap between lip 80 and web 16. Those skilled in the art will recognize that some coating operations may be performed in enclosures that allow for pressures to be established that are above atmospheric. In these instances there will still be a pressure differential. That is, the pressure below the bead 86 will still be less than the pressure above the bead 86. By way of example, the pressure below the bead 86 may be maintained at atmospheric when the pressure above the bead 86 is slightly higher than atmospheric. Thus, although the examples presented herein were performed with a "vacuum pressure" below the coating bead 86, it is believed that the present invention also has applicability to those other bead coating operations where there is a pressure differential across the coating bead. In other words, the present invention should be advantageous to those bead coating operations where the pressure below the bead 86 is less than the pressure above the bead 86 and such pressure differential is not created by maintaining a subatmospheric pressure below the bead 86.

Vacuum pressure noise is usually of lesser magnitude at lower vacuum pressure levels. The vacuum pressure noise induced component of coating non-uniformity, which is often the dominant component, is directly proportional to the product of the vacuum pressure noise and the vacuum pressure noise Sensitivity. Thus, if the vacuum pressure noise decreases more than the vacuum pressure noise Sensitivity increases, coating non-uniformity will be reduced. if the coating window includes zero vacuum pressure (atmospheric pressure), then acceptable coating is possible without the aid of vacuum pressure, which greatly simplifies the coating operation. These advantages apply to any coating method that may use vacuum pressure, for example the slide bead and the extrusion methods.

The invention has been discussed herein with particular reference to slide bead coating operations. Those skilled in the art will recognize that the present invention may be practiced in conjunction with other bead coating processes such as, for example, extrusion hopper bead coating.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in an illuminating sense.

PARTS LIST

10 apparatus
12 section
14 section
16 web
17 generic rollers
18 first web surface
20 second web surface
22 grounded conductive backing roller
24 negatively charged electrode
26 negatively charged electrode
28 DC potential source
30 electrode
32 electrode
34 DC current ionizer
36 DC current ionizer
38 DC high voltage power supply
40 DC high voltage power supply
42 conductive plate
44 bipolar high voltage system
46 feed back control system
48 sensor array
50 electronic controller
52 grounded roller
53 induction probe
54 backing roller
55 high voltage DC source
56 controller
57 surface
58 slide bead coater/hopper
60 first coating composition
62 first supply vessel
64 second coating composition
66 second supply vessel
68 first delivery system
70 second delivery system
72 first delivery line
74 second delivery line
76 first distribution passage way
78 second distribution passage way
80 hopper lip
82 layer
84 layer
85 hopper slide surface
86 hydraulic coating bead
88 close-fitting vacuum box
90 conduit
92 gap
94 lower surface
96 wetting line

What is claimed is:

1. A method of improving a coating window and/or generating an additional coating window in a coating operation for coating a moving web with a slide bead coating apparatus comprising the steps of:

(a) forming a bottom layer on a slide surface of the slide bead coating apparatus with a pseudoplastic liquid composition having a viscosity of at least about 8 centipoises at a shear rate of 100 $sec^{-1}$ and a viscosity below 10 centipoises at a shear rate of 100,000 $sec^{-1}$;

(b) establishing a coating bead between a lip of the slide bead coating apparatus and the moving web supported on a back-up roller thereby coating the moving web; and (c) generating an electrostatic field in an air gap between the coating bead and the moving web just prior to a dynamic wetting line by creating a potential difference across the air gap of between about 300 and about 2000 volts.

2. A method of coating a moving web with a slide bead coating apparatus comprising the steps of:

(a) forming a bottom layer on a slide surface of the slide bead coating apparatus with a pseudoplastic liquid composition having a consistency m>50 and a flow behavior index n<0.7 and a viscosity given by $$\eta=m(d\gamma/d\tau)^{n-1}$$

where $\eta$ is viscosity and $d\gamma/d\tau$ is the shear rate;

(b) establishing a coating bead between a lip of the slide bead coating apparatus and the moving web supported on a back-up roller to thereby coat the moving web; and (c) generating an electrostatic field in an air gap between the coating bead and the moving web just prior to a dynamic wetting line by creating a potential difference across the air gap of between about 300 and about 2000 volts.

3. A method as recited in claim 2 further comprising the step of:

forming at least one upper liquid coating layer above the bottom layer on the slide surface of the slide bead coating apparatus.

4. A method as recited in claim 2 wherein:

the pseudoplastic liquid composition is aqueous.

5. A method as recited in claim 2 wherein:

the pseudoplastic liquid composition includes a shear-thinning thickening agent.

6. A method as recited in claim 5 wherein:

the shear-thinning thickening agent is selected from the group consisting of sodium cellulose sulfate and sodium poly(styrene sulfonate).

7. A method as recited in claim 2 further comprising the step of:

creating a pressure differential such that a pressure above the coating bead is greater than a pressure below the coating bead.

8. A method as recited in claim 7 wherein:

the pressure differential is created with a vacuum pressure below the coating bead.

9. A method as recited in claim 1 further comprising the step of:

forming at least one upper liquid coating layer above the bottom layer on the slide surface of the slide bead coating apparatus.

10. A method as recited in claim 1 wherein:

the pseudoplastic liquid composition forming the bottom layer has a viscosity of less than 5 centipoises at a shear rate of 10,000 $sec^{-1}$.

11. A method as recited in claim 1 wherein:

the pseudoplastic liquid composition is aqueous.

12. A method as recited in claim 1 wherein:

the pseudoplastic liquid composition includes a shear-thinning thickening agent.

13. A method as recited in claim 12 wherein:

the shear-thinning thickening agent is selected from the group consisting of sodium cellulose sulfate and sodium poly(styrene sulfonate).

14. A method as recited in claim 1 further comprising the step of:

creating a pressure differential such that a pressure below the coating bead is less than a pressure above the coating bead.

15. A method as recited in claim 14 wherein:

the pressure differential is created with a vacuum pressure below the coating bead.

16. A method of improving a coating window and/or generating an additional coating window in a coating operation for coating a moving web with a bead coating apparatus comprising the steps of:

(a) forming a bottom layer in a bead coating apparatus with a pseudoplastic liquid composition having a viscosity of at least about 8 centipoises at a shear rate of 100 $sec^{-1}$ and a viscosity below 10 centipoises at a shear rate of 100,000 $sec^{-1}$;

(b) establishing a coating bead between a lip of the bead coating apparatus and the moving web supported on a back-up roller, thereby coating the moving web; and (c) generating an electrostatic field in an air gap between the coating bead and the moving web just prior to a dynamic wetting line by creating a potential difference across the air gap of between about 300 and about 2000 volts.

17. A method as recited in claim 16 further comprising the step of:

forming at least one upper liquid coating layer above the bottom layer on the slide surface of the slide bead coating apparatus.

18. A method as recited in claim 16 wherein:

the pseudoplastic liquid composition forming the bottom layer has a viscosity of less than 5 centipoises at a shear rate of 10,000 $sec^{-1}$.

19. A method as recited in claim 16 wherein:

the pseudoplastic liquid composition is aqueous.

20. A method as recited in claim 16 wherein:

the pseudoplastic liquid composition includes a shear-thinning thickening agent.

21. A method as recited in claim 20 wherein:

the shear-thinning thickening agent is selected from the group consisting of sodium cellulose sulfate and sodium poly(styrene sulfonate).

22. A method as recited in claim 16 further comprising the step of:

creating a pressure differential such that a pressure above the coating bead is greater than a pressure above the coating bead.

23. A method as recited in claim 22 wherein:

the pressure differential is created with a vacuum pressure below the coating bead.

* * * * *